US006988977B2

(12) United States Patent
Webber et al.

(10) Patent No.: US 6,988,977 B2
(45) Date of Patent: Jan. 24, 2006

(54) EXERCISE ARM ASSEMBLY FOR EXERCISE MACHINE

(75) Inventors: Randall T. Webber, San Diego, CA (US); George M. Zink, Escondido, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 302 days.

(21) Appl. No.: 10/417,431

(22) Filed: Apr. 16, 2003

(65) Prior Publication Data

US 2003/0195091 A1 Oct. 16, 2003

Related U.S. Application Data

(63) Continuation of application No. 09/516,093, filed on Feb. 29, 2000, now Pat. No. 6,579,213.

(51) Int. Cl.
*A63B 21/062* (2006.01)

(52) U.S. Cl. ..... 482/100; 482/136; 482/139

(58) Field of Classification Search ..... 482/92–94, 482/97–100, 121–123, 129, 130, 133–139; D21/673, 676, 694
See application file for complete search history.

(56) References Cited

U.S. PATENT DOCUMENTS

| | | | | |
|---|---|---|---|---|
| 5,971,895 | A | 10/1999 | Habing | |
| 6,234,941 | B1 * | 5/2001 | Chu | 482/100 |
| 6,244,999 | B1 * | 6/2001 | Alessandri | 482/142 |
| 6,394,936 | B1 | 5/2002 | Voris | |
| 6,500,106 | B1 * | 12/2002 | Fulks | 482/137 |
| 6,592,498 | B1 * | 7/2003 | Trainor | 482/97 |

OTHER PUBLICATIONS

Linear StairMaster, brochure, date unknown.*
Pacific Fitness, Pec Fly/Rear Deltoid Machine, brochure, 1998.*

* cited by examiner

*Primary Examiner*—Jerome W. Donnelly
*Assistant Examiner*—Victor K. Hwang
(74) *Attorney, Agent, or Firm*—Gordon & Rees LLP

(57) ABSTRACT

An exercise arm assembly for mounting on an exercise machine frame has a main arm, a swing arm, and a handle. The main arm has a first end for pivoting on a frame of the machine to pivot about a first pivot axis. The swing arm has a first end pivoted to the second end of the main arm for pivoting about a second pivot axis. The handle is pivoted to the swing arm for pivoting about a third pivot axis, with each pivot axis being perpendicular to the other two pivot axes to form a perpendicular, tri-pivot arm system.

30 Claims, 8 Drawing Sheets

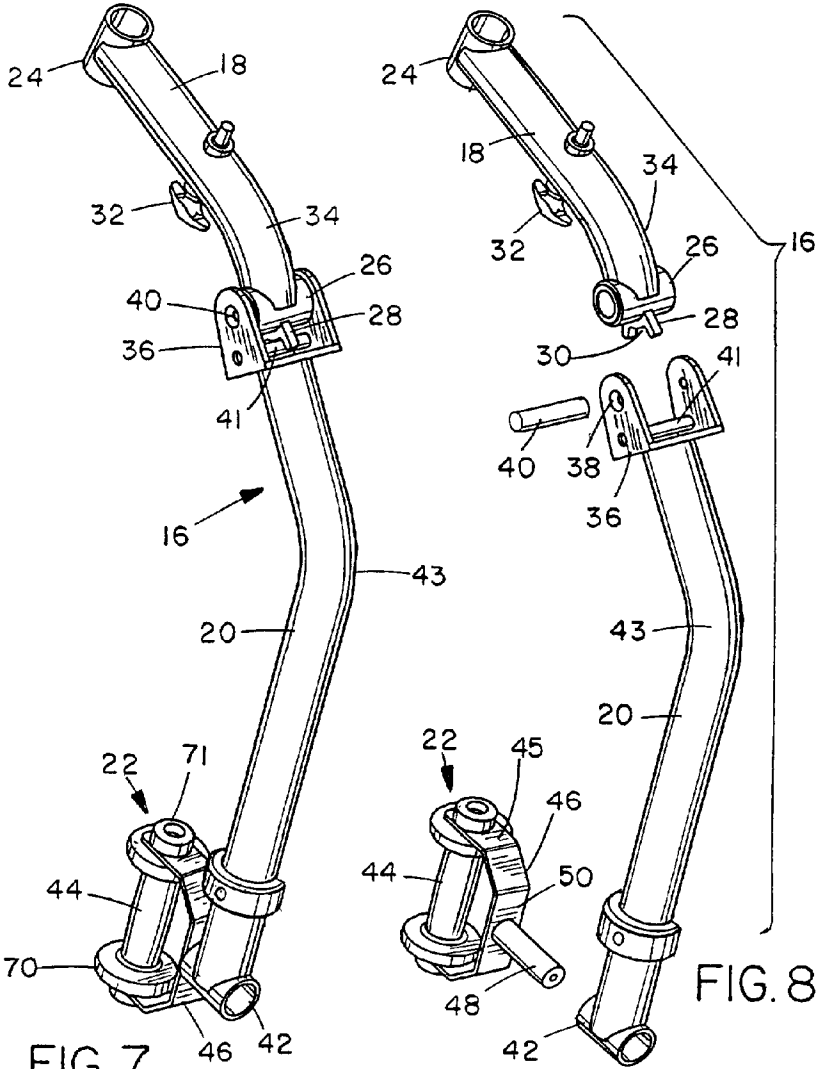
FIG. 8
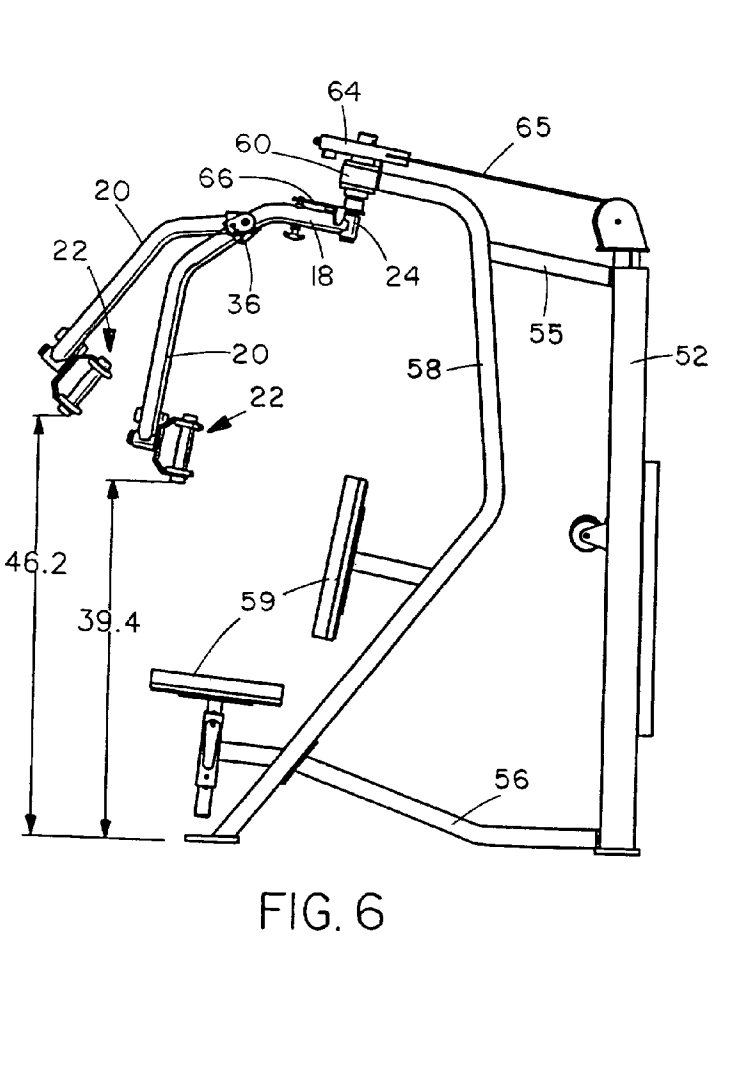
FIG. 7
FIG. 6

110
112
71
115
70
117
114
118

128
132
124
130
126
138
110

126
130
124
110
134
136

128
132
124
130
126
138
110

120
122
124
128
132
130
126
138
110
117
136
134
29.5°

EXERCISE ARM ASSEMBLY FOR EXERCISE MACHINE

CROSS REFERENCE TO RELATED APPLICATIONS

This application is a continuation of application Ser. No. 09/516,093 filed Feb. 29, 2000 now U.S Pat. No. 6,579,213.

BACKGROUND OF THE INVENTION

The present invention relates generally to weight-lifting exercise machines, and is particularly concerned with exercise arms for such machines for use in performing upper body exercises.

Various upper body exercises are performed for exercising different upper body muscle groups, such as pectoral (pec) fly, rear deltoid, chest press, and mid row exercises.

Originally, these upper body exercises were performed using hand-held weights. For pec fly and rear deltoid exercises, independent weights known as dumbbell were held in each hand. Chest press and mid row exercises could be performed using either a barbell, where a single weight is controlled by both hands, or two separate dumbbell. In a pec fly exercise, the exerciser would lie on a bench facing upwards with a weight in each hand, arms extended out to the side, and palms facing up, with the elbows bent. The exerciser would then lift the weights to bring the dumbbell together over their body with a slight arcing or elliptical pattern to the movement. For a rear deltoid exercise, the exerciser would lie face down on a bench with a dumbbell in each hand, with their arms straight down, palms facing each other, and elbows slightly bent. Keeping the arms in the same bent position, the exerciser would lift the weights until their arms were straight out to the side.

In order to perform a chest press using dumbbell, the exerciser would lie face up on a bench with a weight in each hand, arms to each side with elbows bent and hands close to the chest. The exerciser would then push the weights up, bringing the dumbbell together over their body in a slight arcing or elliptical movement. In a mid row exercise, the exerciser would bend over at the waist with a weight in each hand, arms hanging straight down, and hands together with the palms facing each other. Staying in the bent position, the user would then pull the weights up to chest level with a slight arcing or elliptical pattern to the movement.

Various exercise machines have been designed in order to duplicate one or more of the free weight, upper body exercises such as pec fly, rear deltoid, chest press, and mid row. Typically, these machines have pivoted arms linked to an exercise resistance. There are several problems in attempting to combine two or more of the upper body exercises with a single exercise arm assembly, due to the different motions which must be accommodated for each exercise.

The earliest pec fly machine had two independent exercise arms pivotally mounted on a frame above the user's head. The arms were generally L-shaped with a pivot shaft attached to the end of one leg of the L and a pad or roller attached to the other leg. The user sat on a seat mounted on the frame with their upper arms parallel to the floor and forearms bent 90 degrees at the elbow. With their forearms resting against the pads, the user rotated their arms forward until they came together. Since the exercise arms had only one pivot, they could only move in a concentric or circular pattern, and the arms were non-adjustable for different users. In order to perform a rear deltoid exercise on this machine, a user would sit facing the rear of the machine, placing their elbows on the pads, and trying to rotate their arms rearwards. This was a cramped, uncomfortable position which did not allow a full range of motion, and was of marginal value from an exercise point of view.

In view of the limitations of the earliest pec fly machine in performing rear deltoid exercises, a separate rear deltoid machine was designed, which allowed users to fully extend their arms and perform a full range of exercise motion. This machine had a second pivot to pivotally mount a handle at the bottom of the second leg of the L-shaped arm. The handle was T-shaped, with the bottom of the T pivotally secured to the exercise arm and the grip portion of the handle comprising the top of the T and oriented vertically. This machine could also be used for pec fly exercises, and had the advantage that the user's hands were placed in a more natural position.

A combination pec fly/rear deltoid machine encounters difficulties due to the fact that the two exercise movements are different. In the rear deltoid exercise, the natural position for the arms is fairly straight with a slight bend or break at the elbows throughout the entire movement, which is circular or concentric. In a pec fly exercise, the natural movement is more elliptical, since the starting width of the exerciser's grip is closer to their body at the beginning of the exercise than at the end. In order to function properly for both exercises, the original combination machines had to have a T handle short enough to provide the necessary pre-stretch for a rear deltoid exercise. This handle was not quite long enough to provide the swing necessary for the proper elliptical arc on a pec fly exercise.

In later machines, the rotating handle was eliminated and replaced with a swing arm, which hinged at the elbow of the L-shaped exercise arm. The second pivot was perpendicular to the first pivot at the top of the exercise arm, and at the same elevation as the first pivot. Pads or handles were mounted to the swing arms to engage the user's forearms or hands.

Various machines have also been designed for performing press type exercises. U.S. Pat. No. 5,916,072 of Webber describes an exercise apparatus with an exercise arm assembly for performing chest press and mid row exercises. A pair of swing arms are pivoted at opposite sides of a U-shaped, pivoted yoke. Various alternative configurations are described, including some in which the swing arms have two pivoting sections. All the designs have parallel pivots and cannot provide a converging, pulling exercise movement. This design will not work for a combination machine with pushing/pulling converging movement.

U.S. Pat. No. 5,181,896 of Jones describes an exercise machine for performing incline press exercises which has independent, fixed arc, converging exercise arms. This can be used for only one type of exercise. U.S. Pat. No. 5,643,252 of Simonson describes independent, single piece exercise arms that travel in a fixed arc and can be used for performing chest press exercises. The handles are rigidly secured to the exercise arms.

None of the prior art exercise machines for performing upper body exercises have exercise arms which can readily duplicate the motions required for both pushing and pulling exercises, and which can adjust readily for user's arm length and desired starting pre-stretch. Additionally, the handles provided in prior art machines often have limited or no ability to adjust to the most natural hand/wrist position throughout the entire exercise movement. A number of prior art machines allow only one, fixed hand position during the entire exercise, and allow little or no adjustment of the arc of the exercise movement.

SUMMARY OF THE INVENTION

It is an object of the present invention to provide a new and improved exercise arm assembly for an exercise machine which can be used for either pushing or pulling exercises, or used on a combination machine for performing both types of exercise.

According to the present invention, an exercise arm apparatus is provided which comprises a pair of exercise arm assemblies, each arm assembly having a main arm having a first end for pivoting on a frame of an exercise machine for pivoting about a first pivot axis, a swing arm having a first end pivoted to the main arm for pivoting about a second pivot axis, and a handle pivoted to the swing arm for pivoting about a third pivot axis, each pivot axis being perpendicular to the other two pivot axes.

In prior art exercise arm assemblies with multiple pivots, there were always at least two pivot axes extending parallel to one another. In the present assembly, the perpendicular, tri-pivot system, in which each pivot axis is perpendicular to both of the other pivot axes, provides a multi-dimensional exercise arm which can perform both concentric and eccentric exercise movements. Preferably, the first pivot axis is vertical while the other two are horizontal, perpendicular pivot axes. Because of this, the handles can be positioned so that they are on the inboard side of the swing arms, facing the user, at all times. This allows the handles to be completely adjustable and self-aligning during either a pec fly or rear deltoid exercise, and provides the user with an unlimited number of hand positions.

Preferably, the main arm has a downwardly angled bend, so that the swing arm hinges to the main arm below the level at which the main arm pivots to the frame. The swing arm preferably also has an angled bend, so that it angles outwardly from its pivotal connection to the main arm, and then downwardly to the handle. This allows the second pivot axis to be brought in closer to the exerciser, while still allowing the swing arm and handles to swing out wide enough to perform the various exercises correctly. The swing arms are free swinging and are not affected by the resistance, nor do they affect the resistance.

The rotation of the swing arm about the second pivot axis is preferably limited by a range limiting system, comprising a pin connected to one of the arms and a pair of spaced end stops on the other arm to engage the pin as the swing arm is rotated in opposite directions about the second pivot axis. Preferably, the end stops are arranged to define a first, inner end position of the swing arm in which it is positioned in a generally vertical orientation and a second, outer end position of the arm in which it is angled outwardly. The second end position is designed to restrict the outward movement of the swing arm so as to prevent contact with the machine frame.

The handle preferably has a pivoting grip mounted perpendicular to the third, or handle, pivot axis. The grip pivots freely about its axis and allows the user to adjust their hand/wrist position at any time during the course of an exercise without causing strain or binding to the wrist.

The combination of pivoting grip, handle and swing arm allows the user to determine their ideal exercise path, and provides self-alignment during the course of the exercise movement. As the swing arms are raised, the handles will automatically adjust to keep the user's hands in the most natural and comfortable position.

The independent, multi-pivoting exercise arms of this invention transform traditional, single plane rotary movement exercises into multi-plane elliptical movements that bring a greater number of muscle groups into play and increase their involvement for a more effective workout. The user can selectively perform single plane rotary and user defined elliptical and multi-plane movements, making the apparatus much more versatile than prior art exercise arm assemblies. The ability of the handles to adjust and self-align, providing an unlimited number of possible hand positions, is important for the comfort of the user, particularly when the apparatus is used in the medical/rehabilitation industry where certain injuries can preclude the use of a fixed hand position.

BRIEF DESCRIPTION OF THE DRAWINGS

The present invention will be better understood from the following detailed description of some preferred embodiments of the invention, taken in conjunction with the accompanying drawings in which like reference numerals refer to like parts and in which:

FIG. 6 is a side view of the machine showing different positions of the two arms;

FIG. 7 is an enlarged perspective view of one arm;

FIG. 8 is a similar view with the arm components separated;

DESCRIPTION OF THE PREFERRED EMBODIMENTS

Figure 2:
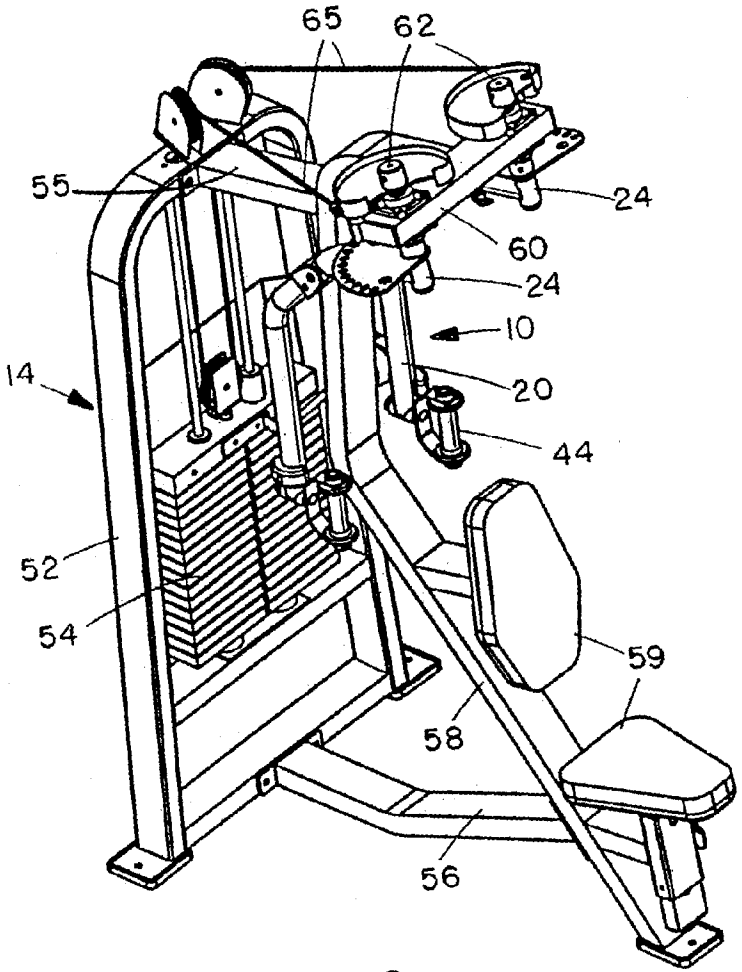
FIG. 2 is a similar view showing the arms in retracted position.

FIGS. 1 to 6 of the drawings illustrate an exercise arm apparatus 10 according to a first embodiment of the present invention mounted in an overhead position on the frame 12 of an exercise machine 14. FIGS. 7 and 8 illustrate one of the arm assemblies 16 of the exercise arm assembly in more detail. It will be understood that the two arm assemblies 16 are identical in structure, and like reference numerals have been used for like parts as appropriate.

As best illustrated in FIGS. 7 and 8, each arm assembly 16 basically comprises a main arm 18 for linking to an exercise resistance, a swing arm 20 hinged to the main arm 18, and a handle 22 pivoted to the end of swing arm 20. The swing arm is free swinging and not directly connected to the exercise resistance so that it neither affects nor is affected by the exercise resistance. The main arm 18 has a first pivot sleeve or connector 24 at one end for pivotal connection to the frame 12, and a second pivot sleeve 26 at the opposite end for pivotal connection to swing arm 20. The second pivot sleeve 26 extends perpendicular to the first pivot sleeve 24. A flange 28 forming a range limiting notch or indent 30 protrudes from the lower face of pivot sleeve 26. A spring loaded pop pin or lock pin 32 extends transversely through main arm 18 at a location between its opposite ends. The arm 18 also has an angled bend 34 adjacent the second pivot sleeve 26.

The swing arm 20 has a generally U-shaped pivot mount or bracket 36 at one end. Bracket 36 has aligned openings 38 for engagement over and alignment with the pivot sleeve 26. A pivot shaft 40 engages through the aligned openings 38 and sleeve to pivotally secure the swing arm 20 to the main arm 18. A stop pin 41 is secured across bracket 36 beneath the openings 38 to engage the range limiting notch 30 and control the arc through which the swing arm can move. When the parts are assembled as in FIG. 7, swing arm 20 can swing back and forth about the pivot axis defined by shaft 40 through an angular range limited by engagement of stop pin 41 with the opposite ends of notch 30.

A third pivot sleeve 42 is secured transversely to the opposite, or lower, end of swing arm 20, and defines a third pivot axis which is perpendicular to the first and second pivot axes defined by pivot sleeves 24 and 26. Swing arm 20 also has an angled bend 43 at an intermediate point in its length, such that when the parts of the arm assembly are secured together as in FIG. 7, the overall assembly has three generally straight portions with two angled bends 34,43 separating the straight portions.

The arm assembly of FIG. 7 thus has a perpendicular tri-pivot system in which all of the pivots are perpendicular to each other. The bend 34 ensures that the swing arm 20 hinges below the level where the main arm 18 pivots to the machine frame, when the arms are installed in an overhead arrangement.

The handle 22 comprises a grip member or roller 44 rotatably mounted between opposite arms 45 of a generally C-shaped bracket 46. A pivot shaft 48 extends transversely outwardly from the central portion 50 of bracket 46 for rotatable engagement in pivot sleeve 42 at the end of swing arm 20.

Figure 1:
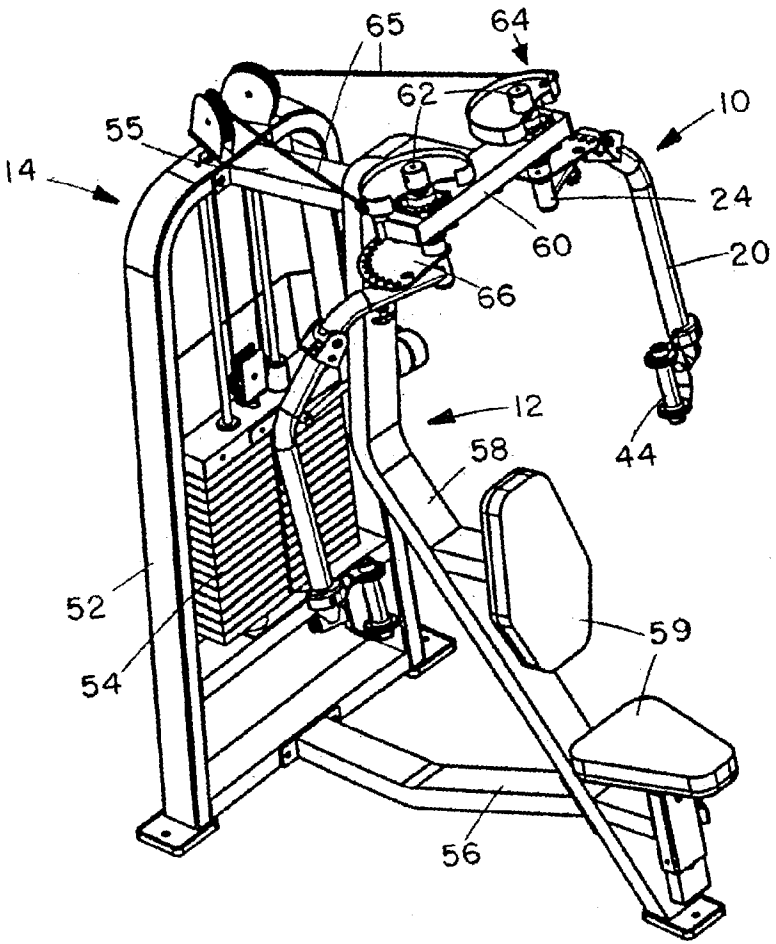
FIG. 1 is a perspective view of an exercise machine incorporating the first hinged arms according to a first embodiment of the invention, with the arms shown in extended position.
Figure 3:
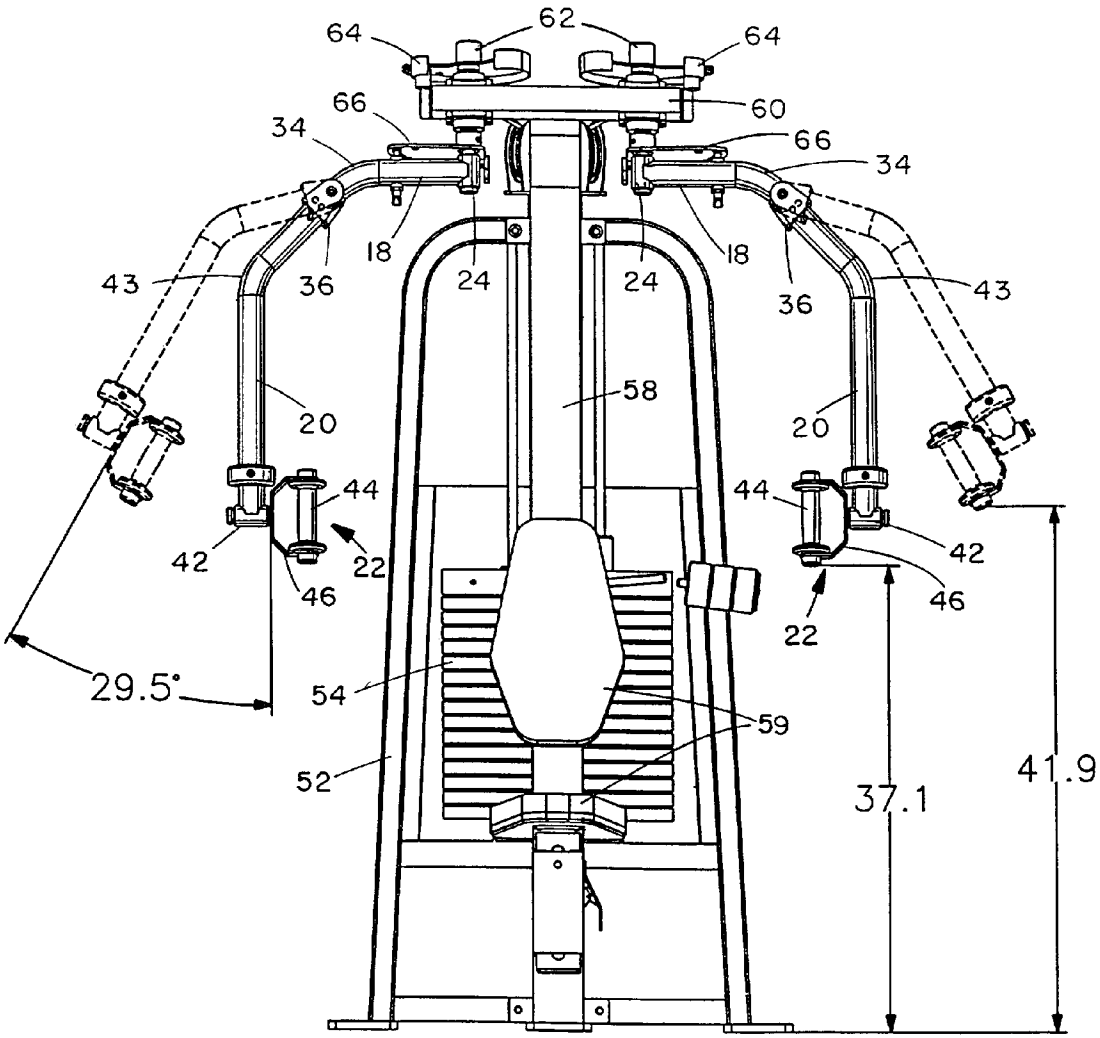
FIG. 3 is a front view of the structure of FIG. 1, showing the range of motion of the arms.

Two arm assemblies 16 may be pivotally mounted on the frame 12 of an exercise machine 14 in an overhead position as illustrated in FIGS. 1 to 3. It will be understood that the assemblies 16 may alternatively be mounted at different positions on the frame 12, such as in a low pivot or horizontal pivot position, or on the frame of a machine of different design to that illustrated.

The frame 12 basically comprises a rear, upright rectangular support or enclosure 52 for a slidably mounted, conventional weight stack 54, and upper and lower struts 55,56 projecting forwardly from the top and bottom of enclosure 52, respectively, with a generally upright support 58 secured to the struts 55,56. A seat 59 for the exerciser is mounted on support 58 in a conventional manner. The arm assemblies 16 are pivotally suspended from opposite ends of a cross bar or member 60 secured across the upper end of support 58. A pair of vertical pivot shafts 62 are rotatably mounted through openings at opposite ends of member 60 and extend into the respective pivot sleeves 24 at the upper end of each arm assembly, as best illustrated in FIG. 3. Each pivot shaft 62 is secured to a cam 64 which in turn is linked to a cable 65 by which the respective main arm 18 is linked to the exercise resistance or weight stack via a cable and pulley linkage, as illustrated in FIGS. 1,2,4 and 5.

Figure 4:
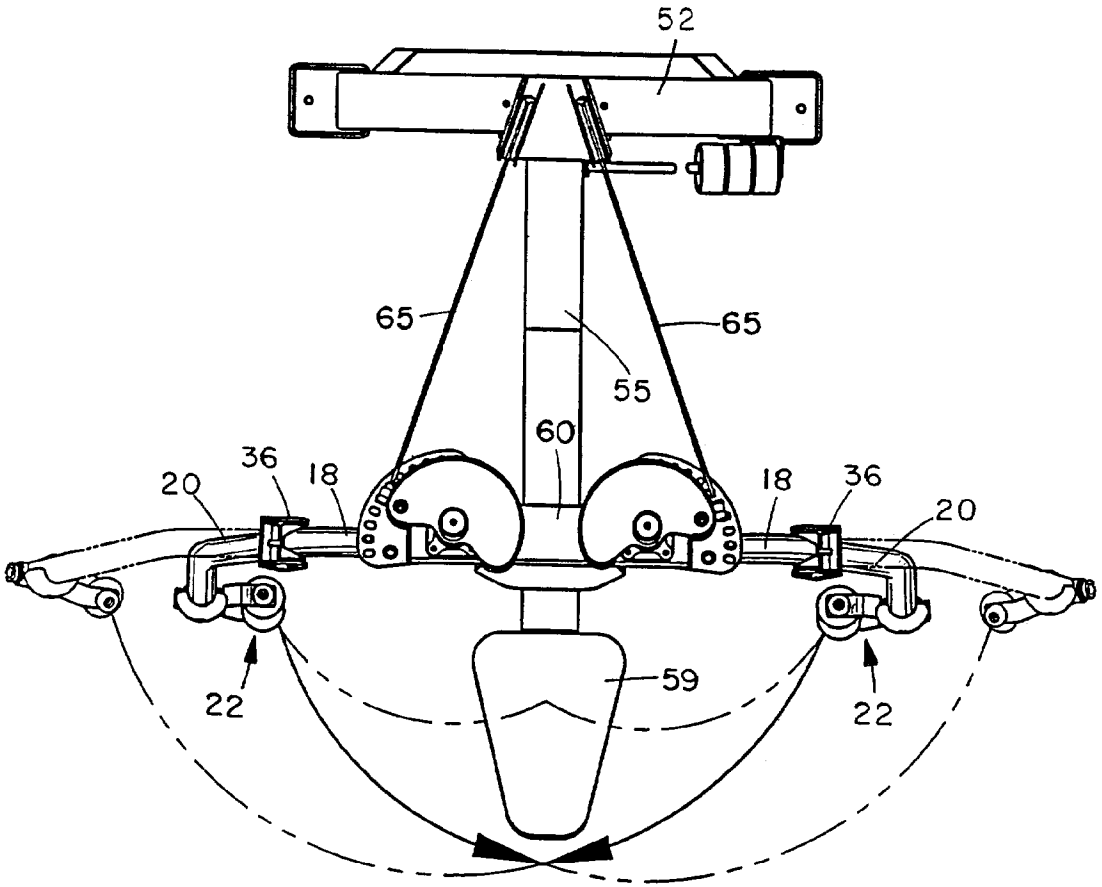
FIG. 4 is a top view of the structure of FIG. 3, also showing the arm motions.
Figure 5:
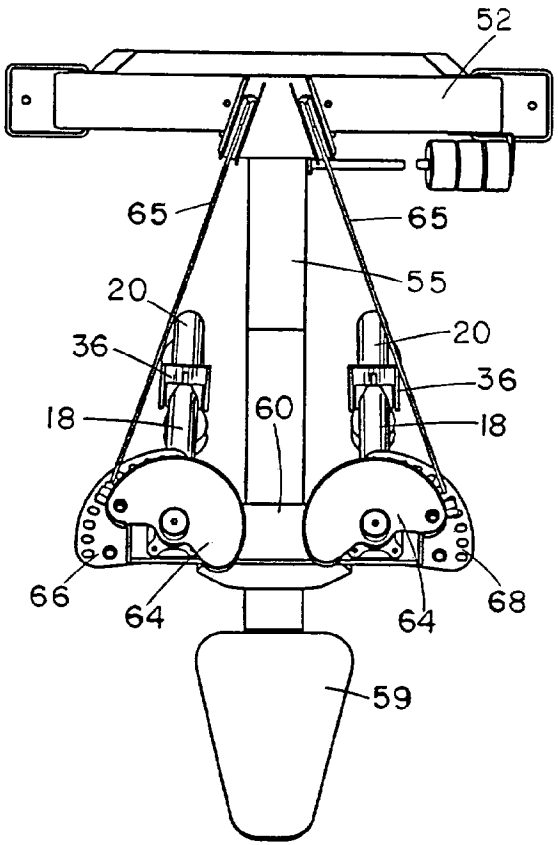
FIG. 5 is a top view of the structure of FIG. 2.

A range of motion (ROM) plate 66 is mounted on each pivot beneath each end of bar 60. Each plate 66 has a series of spaced openings 68 extending in an arc. The pull pin or lock pin 32 on each main arm 18 is selectively engaged in one of the openings 68 in the respective ROM plate in order to secure the arm assembly to the pivot shaft 62 at a selected initial orientation relative to cross bar 60, depending on the type of exercise to be performed. FIGS. 1 and 4 illustrate the arms positioned in the forward starting position for a pectoral fly exercise. FIGS. 2 and 5 illustrate the arms in a rearward start position for performing a rear deltoid exercise. Thus, in FIG. 1, the lock pin 32 is engaged in one of the front openings in ROM plate 66, while in FIG. 2 it is engaged in one of the rear openings.

FIG. 3 illustrates the permitted range of swinging motion of each swing arm 20 relative to the main arm 18 about the pivot axis defined by pivot pin 40. The range limiter formed by stop pin 41 engaging in notch 30 limits the permitted angular motion of arm 20 to around 29.5 degrees, as indicated in FIG. 3, between an initial vertical starting position illustrated in solid lines and an end position illustrated in dotted lines. The permitted range of motion will be determined by the position of the adjacent frame structure, and will vary with different machine designs and dimensions. The limiter is arranged to make sure that the arms do not make contact with the machine frame.

The swing arm hinges below the level where the main arm pivots to the frame, and is angled outwardly and downwardly from this hinge point. Both the main arm and the swing arm have angled bends 34 and 43, respectively, and the swing arm hinge point 40 is in the middle of the section between these bends. By angling the swing arm outwardly past the hinge point or hinge connection 40, the hinge point can be brought in closer to the exerciser, while still permitting the swing arm and handle to swing out wide enough to perform the various exercises properly. This feature, along with the fact that the swing arm hinges below the level of the main arm pivot, permits a greater increase in handle elevation when the swing arm is moved outward than is possible with prior art pivoted exercise arms. As illustrated on the right hand side of FIG. 3, the starting elevation of handle 22 is around 37.1 inches, while the final elevation when the arm is extended outwardly as far as possible is around 41.9 inches. Thus, the increase in angle elevation is nearly five inches, as compared with an increase of only two inches in typical prior art swing arms. This provides greater adjust-ability and change in elevation during an exercise movement, bringing more chest muscles into play and providing a more effective workout.

The swing arm range limiter is arranged to allow the swing arm to rest in a generally vertical orientation when not in use, and restricts the outward motion of the arm to prevent contact with the machine. Thus, the swing arm and handle do not have to travel inward past the vertical position to accommodate users with shorter arms, as was sometimes necessary in prior art devices.

The pivoting handles 22 are positioned so that they are inboard of the swing arms, as best illustrated in FIG. 3, and face the user at all times, making gripping and manipulating the handles more convenient. The handles are freely rotatable about the axis of pivot or hinge pin 48. The grips 44 are mounted perpendicular to hinge pin 48 and are also free pivoting. This allows the user to adjust their hand/wrist position at any time during the course of an exercise, without causing strain or binding to the wrist. The combination of pivoting grip, handle, and swing arm allows the user to determine their ideal exercise path and provides self-alignment during the course of the exercise movement. As the swing arms are raised, the handles will automatically adjust to keep the user's hands in the most natural and comfortable position. The grips 44 are preferably of rubber material and are formed to fit the shape of the hand. Built in annular guards 70 at the opposite ends of each grip prevent the user's hands from contacting each other during an exercise. Raised rubber projections or bumpers 71 project axially outwardly from the handle bracket 46 at each end of the handle to keep the hands separate when the handles are oriented horizontally during an exercise movement.

The operation of the exercise arm assembly to perform a pectoral fly exercise will now be described, with reference to FIGS. 1,4,6 and 9. An exerciser first sits in the seat 59 facing forwards, with the exercise arms in the start position illustrated in FIG. 1, and grips the handle grips 44 with each hand, with the arms outstretched to either side and the elbows bent. They then rotate their arms forward, to the front of their body, in an elliptical or eccentric movement pattern, slightly extending their arms and bringing their hands together at the finish position illustrated in FIG. 9. This duplicates the natural movement pattern of the body and is the same basic movement pattern as with dumbbell, except that the exerciser is sitting upright.

One advantage of the exercise arm apparatus of this invention over performing a dumbbell fly exercise is that, during the course of the exercise movement, as the swing arms are extended, they are also increasing in elevation. This makes the handles travel through multiple planes and brings more of the chest muscles into play. This is easily accomplished because the user is sitting upright and the swing arms are not connected directly to the load. The load is carried by the main exercise arms 18, which travel in a concentric rotation about the frame, leaving the swing arms free to hinge outward without affecting or being affected by the resistance. The handles can also self-align throughout the course of the exercise movement, without being affected by the resistance, which is not true of the dumbbell exercise.

The exerciser can perform both concentric and eccentric exercise movements as desired, with any selected start position permitted by the range limiter at the pivotal connection between the main arm and swing arm. FIG. 4 illustrates the wide and narrow limits for a concentric exercise path in dotted outline, with different start positions. Any start position between these two end positions will be possible. One possible eccentric exercise path is also illustrated in solid line. It will be understood that a large number of alternative, user-defined eccentric and concentric exercise paths are possible with different start positions and change in elevation during the exercise movement. FIG. 6 illustrate two possible handle elevations at the end of a pec fly exercise, as permitted by the range limiter at the swing arm pivot. In the illustrated example, the handles are at an elevation of 39.4 inches at the end of the movement when the swing arm is at the lowermost position, while they are at an elevation of 46.2 inches when the swing arm movement finishes with the arm at the highest possible elevation, i.e. with the stop pin 41 engaging the upper end of notch 30 of the range limiter flange or plate 28. The arms can finish at any selected elevation between these two extremes, as determined by the user.

Thus, the exercise arm apparatus of this invention transforms a traditional, single plane, rotary movement exercise into a multi-plane, elliptical movement that brings a greater number of muscle groups into play and increases their involvement for a more effective workout. When performing a pec fly movement, the greater the increase in elevation, the more the upper chest muscles are involved during the exercise. This is further enhanced by the pivoting handles 22, which allow the user to supinate (rotate thumb outward) their wrists and bring the heel of their hands together at the end of the movement.

Figure 10:
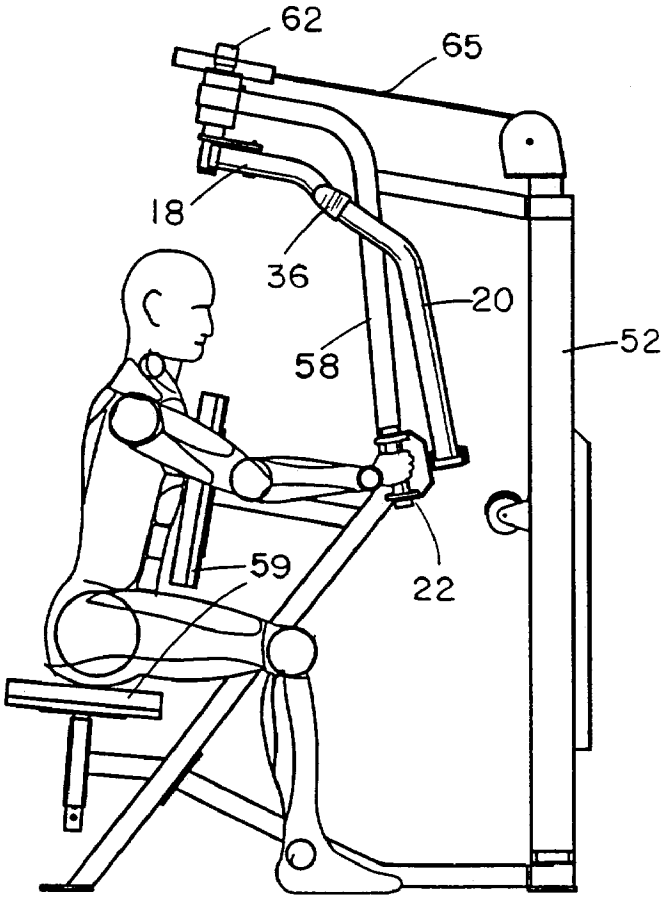
FIG. 10 is a similar side view with the user in a rear facing position.
Figure 9:
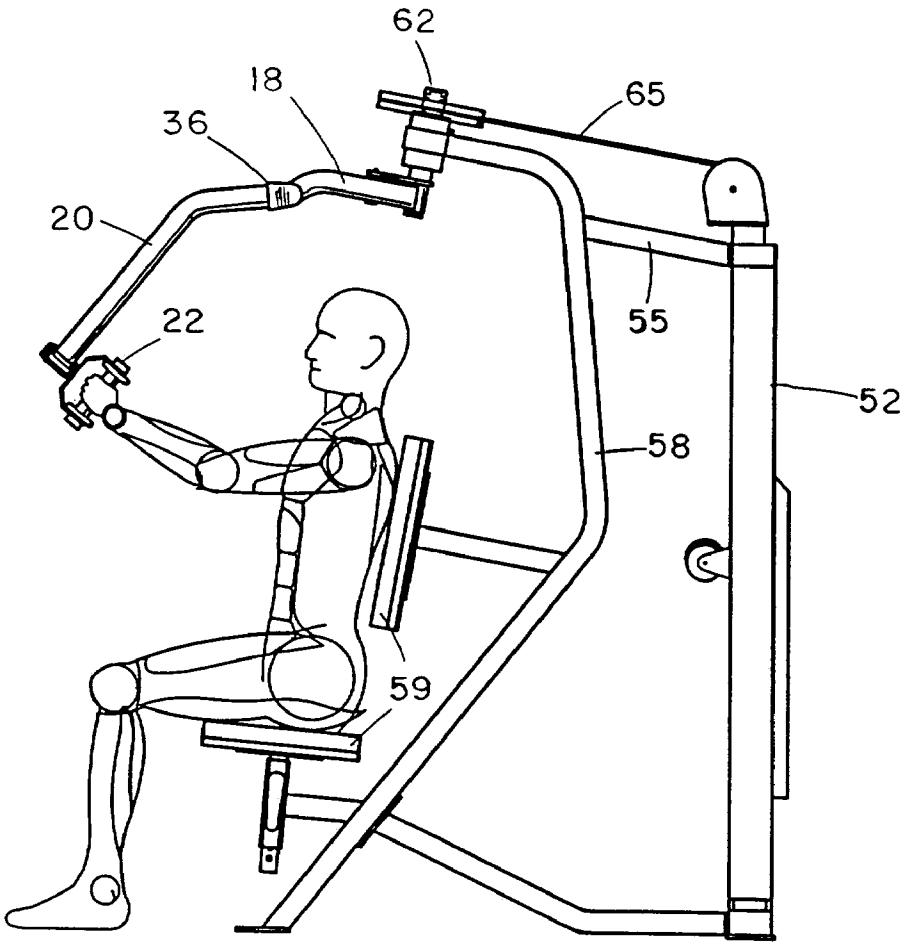
FIG. 9 is a side view of the apparatus with a user in a forward facing position.

The use of the exercise arm apparatus to perform a rear deltoid exercise will now be described, with reference to FIGS. 2, 5 and 10. FIGS. 2 and 5 illustrate the arms in a start position for a rear deltoid exercise. The exerciser sits on seat 59 facing the rear of the machine, as illustrated in FIG. 10, and extends their arms forwardly with elbows bent, gripping the handle grips 44. The arms are then rotated rearward in any selected concentric or elliptical path. The handles adjust and self-align into the most comfortable position for the user during the entire exercise movement.

In the embodiment of FIGS. 1 to 10, the exercise arms are mounted on separate pivots 62 and move independently. FIGS. 11A and 12 illustrate a modified embodiment in which arm assemblies 116 share the same vertical pivot mount 100. The arm assemblies 116 are similar to the previous embodiment, and like reference numerals have been used for like parts as appropriate. As illustrated in FIG. 11A, the pivot sleeve 24 at the upper end of the left hand arm assembly is pivotally engaged over an upper pivot pin 102 rotatably mounted on an upper strut of the machine frame 12. The pivot sleeve 24 of the right hand arm assembly is engaged over a lower pivot pin 103 at a location spaced below the left hand arm. The main arm 18' of the left hand arm assembly 116 is longer than the main arm 18 on the right hand side to ensure that the pivots 40 are at the same height and the handles 22 are in alignment in spite of the different height of the two main arm pivot mounts. In this version, as in the previous embodiment, a range of motion plate 66 is associated with each swing arm assembly 116. Unlike the previous embodiment, where there is a separate cam plate 64 linked to load-bearing cable 65, the outer rim 119 of each ROM plate 66 in this case acts as the cam, reducing the number of parts, and making the assembly more compact.

The exercise arm apparatus mounted as in FIGS. 11A and 12 is used in the same way as the apparatus of FIGS. 1 to 10. FIG. 12 illustrates some of the possible swing arm and handle travel paths when performing a pec fly exercise with the arm assemblies 116. The dotted lines depict the wide and narrow limits for a concentric exercise path. The solid line depicts one possible eccentric exercise path. It will be understood that many more concentric and eccentric exercise paths are possible, as determined by the user.

Figure 11B:
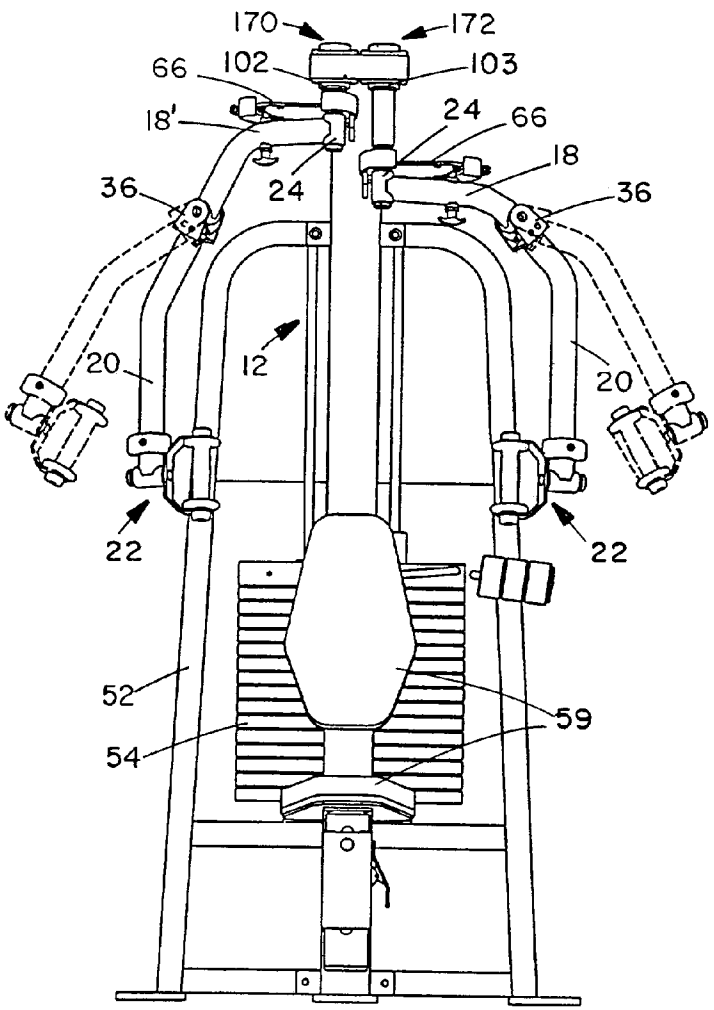
FIG. 11B is a view similar to FIG. 11A, illustrating a modification.
Figure 11A:
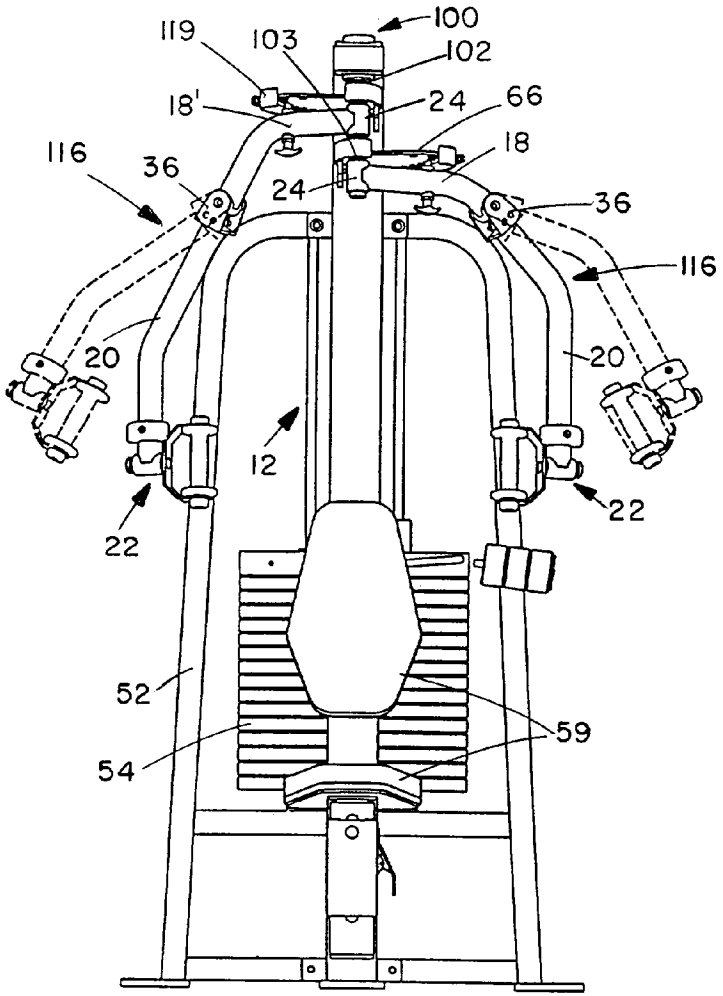
FIG. 11A is a front view of an exercise machine incorporating an exercise arm assembly according to a second embodiment of the invention.
Figure 12:
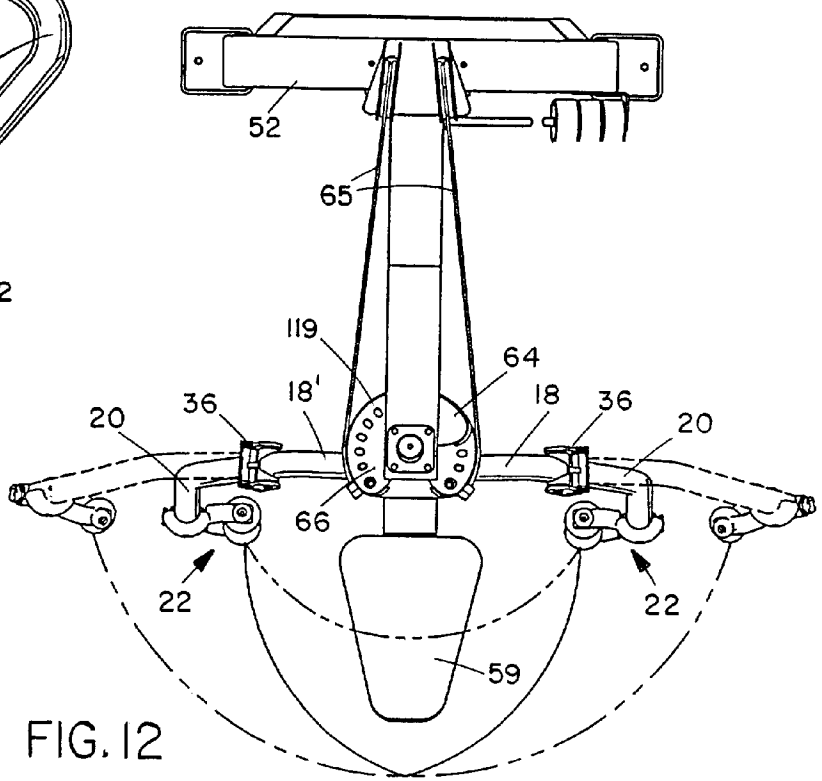
FIG. 12 is a top plan view of the machine of FIG. 11A, showing various possible exercise paths for the handles.

FIG. 11B illustrates a modification of the embodiment of FIG. 11A in which the arm assemblies 116 pivot on two separate, offset pivot axes on pivot pins 170,172, with the right hand arm pivoted at a lower height than the left hand arm to offset the two pivot assemblies and range of motion plates. As in the version of FIG. 11A, the main arm 18' of the left hand arm assembly is longer than the main arm 18 on the right hand arm assembly, so that both swing arms 20 pivot at the same height. Also, in this version as in that of FIG. 11A, the cable wrap cam is incorporated in the range-of-motion plate 66. The offset in FIG. 11B will be used when the cams may overlap if positioned at the same height, as in FIG. 1.

Figures 13, 14, 15A, 15B, 15C:
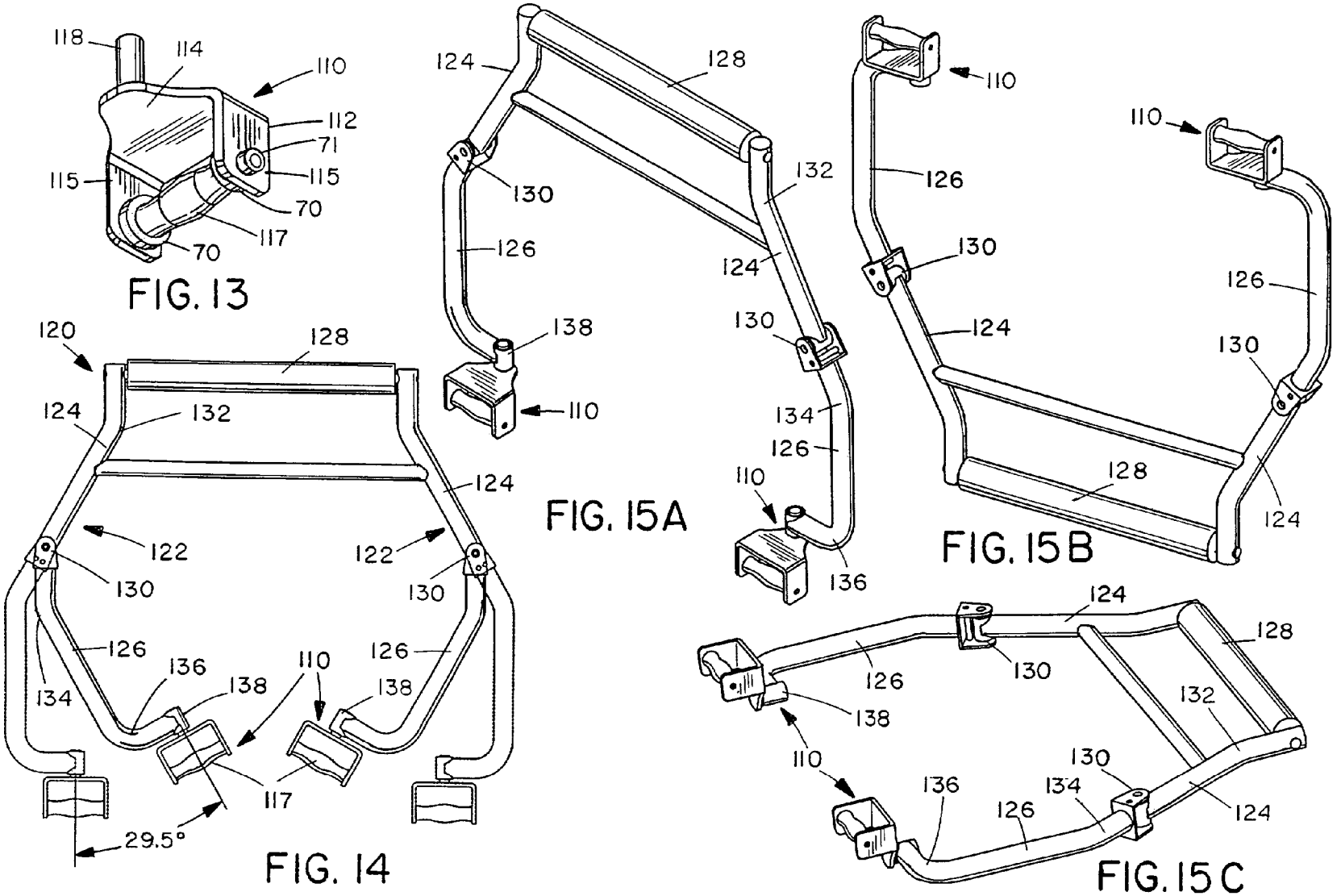
FIG. 13 is a perspective view of a modified swiveling handle for use in the exercise arm assembly.
FIG. 14 is a front view of an exercise arm assembly according to another embodiment of the invention.
FIG. 15A is a perspective view of the assembly of FIG. 14 positioned as an overhead pivot vertical press.
FIG. 15B is a perspective view of the assembly of FIG. 14 positioned as a low hinge vertical press.

FIG. 13 illustrates a modified swiveling handle 110 which may be used in place of the handles 22 in FIGS. 1 to 10 or FIGS. 11 and 12. Handle 110 has a generally U or C-shaped pivot bracket 112 with a flat back plate 114 and a pair of end walls 115 between which the grip 117 is rotatably mounted. Pivot shaft 118 projects rearwardly from back plate 114 at a location offset from the grip 117, unlike handle 22 where the pivot shaft 48 is aligned with grip 44. The grip 117 is preferably of contoured rubber material with a wider or bulging central region for a more comfortable fit in the user's hand. The offset pivot shaft 118 of handle 110 allows the hands to be positioned forward of the swing arm, and could be used for both pulling and pushing/pressing movements. Handle 110 may also have projecting bumpers 71 at each end as illustrated, and grip 117 may have annular guards 70.

FIG. 14 illustrates an exercise arm apparatus 120 according to another embodiment of the invention. In contrast to the previous embodiments, apparatus 120 has dependent arms rather than independent arms, with the arms traveling forward in a linear movement for performing press-type exercises. This apparatus can be used in a combination machine for performing both pulling and pushing, or pressing, exercises. Apparatus 120 comprises a pair of arm assemblies 122 each having a main arm 124, a swing arm 126, and a handle 110, with the main arms 124 being secured together at their outer ends by a pivot shaft extending through pivot sleeve 128. Pivot sleeve 128 is mounted at a selected position on an exercise machine frame, and defines a first pivot axis for the apparatus.

As in the previous embodiments, each main arm 124 is pivotally connected to the associated swing arm 126 by a horizontal pivot pin 130 extending perpendicular to the pivot sleeve 128, allowing the swing arms to rotate outwardly and inwardly through an arc determined by a range limiter arrangement identical to that used in the previous embodiments. The main arm 124 has a single, outward bend 132 adjacent its outer end. The swing arm has a first bend 134 adjacent the pivot connection or pin 130, and a second, inward bend 136 adjacent the handle 110. Pivot sleeve 138 at the handle end of the swing arm extends perpendicular to both of the other pivot axes defined by shaft 128 and pin 130. In the orientation illustrated in FIG. 14, the pivot axes of shafts 128 and 130 are perpendicular, horizontal axes while the pivot axis defined by sleeve 138 is vertical in the outermost, rest position illustrated in dotted outline. Unlike the previous embodiments, the swing arms will be in the outermost position when at rest.

FIGS. 15A, 15B, and 15C illustrate the apparatus of FIG. 14 as it will be oriented when mounted at different locations on an exercise machine frame. FIG. 15A illustrates an overhead pivot orientation, where pivot sleeve 128 is welded to an overhead strut of an exercise machine frame and the arm assemblies extend downwardly from the sleeve 128. This is an overhead vertical press orientation in which the apparatus can be used for performing vertical press exercises. FIG. 15B illustrates the apparatus 120 positioned as a low hinge vertical press, with the sleeve 128 secured on a lower portion of the exercise machine frame and the arm assemblies extending upwardly, generally on opposite sides of a seated user. FIG. 15C illustrates the apparatus positioned as a horizontal press, with the sleeve 128 generally secured to an upright strut of the machine frame behind a seated user, and the arm assemblies extending forwardly on opposite sides of the user. The arm assemblies travel forwards when mounted as in FIGS. 15A and 15B and upward when mounted as in FIG. 15C, in vertical and horizontal press exercises.

As in the previous embodiments, the embodiment of FIGS. 14 and 15 has three perpendicular pivots in each exercise arm, a handle that faces inward towards the user, and an integrated range limiting system for the swing arm movement.

Figure 16:
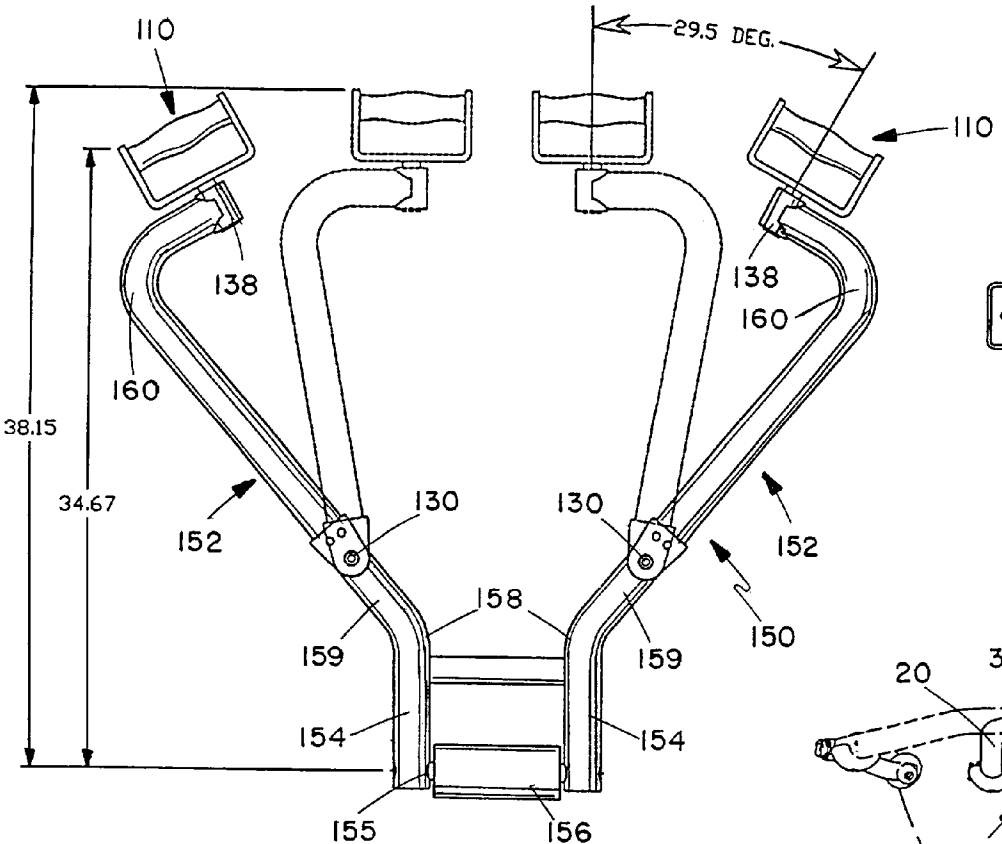
FIG. 15C is a perspective view of the assembly of FIG. 14 positioned as a horizontal press and FIG. 16 is a top plan view of a modified exercise arm assembly for use as a low hinge vertical press.

FIG. 16 illustrates a modified exercise arm apparatus 150 which is similar to that of FIGS. 14 and 15, and like reference numerals are used as appropriate. However, apparatus 150 has swing arms 152 which are angled outward when they are at rest in the widest position. The apparatus 150, as in the PTO previous embodiments, comprises a pair of arm assemblies each having a main arm 154, swing arm 152 and handle 110. The main arms 154 are secured together via pivot shaft 155 which is rotatably engaged in sleeve 156. Sleeve 156 is mounted on the frame of an exercise machine below the user in a low hinge position, with the arm assemblies extending upward. This is similar to the arrangement of FIG. 15B, except that the ends of the main arms 154 are closer together in this embodiment. Each arm 154 has a bend 158 directing the arm generally outwardly away from pivot sleeve 156.

Swing arms 152 are secured to main arms 154 via a pivot connection 130 identical to that of the previous embodiment. Arms 152 form a straight outward continuation from the outwardly bent portions 159 of main arms 154, along the majority of their length, with an inwardly directed bend 160 adjacent the free end to which the handle 110 is pivotally secured.

FIG. 16 illustrates the angular change and elevation change in performing a vertical press exercise with this apparatus. The arm assemblies start at the rest position illustrated in solid outline with the arms angled outward. The handles are also angled in this position. As the arms are extended and brought together during the exercise movement finishing in the dotted line position, the handles straighten to horizontal, causing the arms' hands to pronate slightly.

The exercise arm assembly of this invention overcomes a number of problems of previous pivoted exercise arms. The apparatus works equally well for both pushing and pulling exercises, and is designed to adjust automatically to the user's arm length and desired starting pre-stretch. It also has the ability to self-align during the course of an exercise movement for both the movement arc and the hand/wrist position, and the self-alignment takes place without affecting or being affected by the resistance load.

By dividing each exercise arm into three separate sections which are pivoted together by perpendicular pivots, the handles can be positioned on the inboard side of the swing arms and face the user at all times. Additionally, because the swing arm pivots below the level of the main arm pivot to the frame, and the angled bends are arranged to continue the swing arm outward and downward past the pivot connection, the swing arm hinge point can be brought in closer to the user, while still allowing the swing arm to swing out wide enough to perform the various exercises properly. The lowered hinge point, and outward angle of the swing arm, allows a greater increase in handle elevation at the outermost point of the swing. The swing arms are free swinging, and neither affect nor are affected by the resistance.

The pivoting handles which face the user, together with the fact that the swing arms are brought in closer to the user, and the use of a range limiting system on the swing arm hinge keeping the swing arm in a vertical orientation in the rest position, allow the user to position their wrist at a position which is more comfortable and reduces the mechanical disadvantages for a smaller user with shorter arms. The pivoting handles with rotating grips inward of the swing arms allow for wrist and forearm pronation/supination (rotational movement). This provides multiple possible hand orientations, at any position between horizontal and vertical.

The exercise arms of this invention, when pivoted independently, allow the user to perform either single plane rotary or multi-plane, user-defined elliptical movements which bring a greater number of muscle groups into play and provide a more effective workout. This transforms traditional, fixed arc, linear exercise movement patterns into user-defined, multiple converging/diverging exercise movement patterns.

Although some preferred embodiments of the invention have been described above by way of example only, it will be understood by those skilled in the field that modifications may be made to the disclosed embodiments without departing from the scope of the invention, which is defined by the appended claims.

We claim:

1. An exercise arm assembly, comprising:

a main arm having a first end and a second end, the first end having a first pivot connection for connection to a frame of an exercise machine to allow pivoting of the first end of the main arm about a first pivot axis, the first pivot axis defining an inner position of said assembly;

an elongate swing arm having a first end pivoted to the main arm and a second end;

a second pivot connection directly connecting the first end of the swing arm to the second end of the main arm for pivoting of the swing arm about a second pivot axis, the second pivot connection limiting pivoting of the swing arm relative to the main arm to pivoting about the second pivot axis;

a handle;

the swing arm having a length greater than that of the handle;

a third pivot connection between the handle and the swing arm for pivoting of the handle about a third pivot axis, each pivot axis extending in a non-parallel direction relative to the other two pivot axes; and the swing arm and main arm having adjoining straight portions extending up to said second pivot connection which together form a straight line across said second pivot connection when said arms are in a rest position.

2. The assembly as claimed in claim 1, wherein the second pivot connection includes a range limiting device for limiting the rotation of the swing arm about the second pivot axis to a predetermined angular range, and the swing arm pivots freely about said second pivot axis within said predetermined angular range.

3. The assembly as claimed in claim 2, wherein the second pivot connection comprises a pivot sleeve on one of the arms, a pivot bracket on the other arm, and a pivot pin extending through the bracket and sleeve to rotatably secure the bracket to the sleeve.

4. The assembly as claimed in claim 1, wherein the handle comprises a pivot bracket having a pivot shaft rotatably secured to the swing arm for rotation about said third axis, and a grip rotatably mounted on the bracket for rotation about a fourth axis perpendicular to the third pivot axis.

5. The assembly as claimed in claim 4, wherein the grip extends transverse to the third pivot axis and is not offset from the handle pivot shaft.

6. The assembly as claimed in claim 1, including a releasable lock pin extending transversely through one of the said arms for releasably securing the arm to a range of motion device.

7. An exercise arm assembly, comprising:

a main arm having a first end and a second end, the first end having a first pivot connection for connection to a frame of an exercise machine to allow pivoting of the first end of the main arm about a first pivot axis, the main arm having a first angled bend defining a first portion extending from the first end to the bend and a second, straight portion extending from the bend to the second end;

an elongate swing arm having a first end and a second end, the swing arm having a second angled bend defining a third, straight portion extending from the first end of the swing arm to the second bend and a fourth portion extending from the second bend to the second end of the swing arm;

a second pivot connection between the first end of the swing arm and the second end of the main arm for pivoting of the swing arm about a second pivot axis, the second pivot connection limiting pivoting of the swing arm relative to the main arm to pivoting about the second pivot axis;

a handle; and a third pivot connection between the handle and the second end of the swing arm for pivoting of the handle about a third pivot axis, each pivot axis being non-parallel to the other two pivot axes;

the main arm and swing arm being pivotable about said respective axes between a rest position and an extended position in performing exercises; and the second and the third straight portions together forming a straight line between said bends when the arms are in said rest position.

8. The assembly as claimed in claim 7, wherein the swing arm has a third, inward bend adjacent the handle defining a fifth portion extending inwardly from the third bend to the handle.

9. An exercise arm assembly, comprising:

a main arm having a first end and a second end, the first end having a first pivot connection for connection to a frame of an exercise machine to allow pivoting of the first end of the main arm about a first pivot axis;

an elongate swing arm having a first end and a second end;

a second pivot connection between the first end of the swing arm and the main arm for pivoting of the swing arm about a second pivot axis;

a handle; and a third pivot connection between the handle and the swing arm for pivoting of the handle about a third pivot axis, each pivot axis being non-parallel to the other two pivot axes;

the second pivot connection comprising a pivot sleeve on one of the arms, a pivot bracket on the other arm, and a pivot pin extending through the bracket and sleeve to rotatably secure the bracket to the sleeve; and the second pivot connection including a range limiting device for limiting the rotation of the swing arm about the second pivot axis to a predetermined angular range, the range limiting device comprising a limiter member on the sleeve having a slot defining said angular range, and a pin mounted on the bracket for engagement in the slot;

the swing arm pivoting freely about said second pivot axis in said predetermined angular range, whereby the user can define the motion of the swing arm.

10. An exercise arm apparatus, comprising:

a pair of exercise arm assemblies;

each arm assembly having a main arm, a swing arm, and a handle;

each main arm having a first end and a second end, a first pivot connection at the first end of the main arm for connection to a main frame of an exercise machine for pivoting of the main arm about a first pivot axis respect to the main frame;

each swing arm comprising an elongate member having a first end and a second end;

a second pivot connection directly connecting the first end of each swing arm to the second end of the respective main arm for pivoting of the swing arm about a second pivot axis, the second pivot connection limiting pivoting of the swing arm relative to the main arm to pivoting about the second pivot axis;

each handle having a third pivot connection connecting the handle to the respective swing arm for pivoting of the handle about a third pivot axis, each pivot axis being non-parallel to the other two pivot axes; and the first pivot axis, main arm, and swing arm of each arm assembly operating in a common plane; and the swing arm pivoting freely about said second pivot axis over at least a predetermined range of motion, whereby the user can define the motion of the swing arm.

11. The apparatus as claimed in claim 10, including a pivot shaft extending between the first ends of the main arms, and a pivot sleeve rotatably mounted on the pivot shaft for securing at a selected location on an exercise machine frame.

12. The apparatus as claimed in claim 10, wherein the main arm of a first one of the exercise arm assemblies is longer than the main arm of a second one of the exercise arm assemblies, whereby the main arms can be pivotally mounted in vertical alignment with the first end of the main arm of the first exercise arm assembly above the first end of the main arm of the second exercise arm assembly, with the second pivot axes positioned at the same height.

13. The apparatus as claimed in claim 10, wherein at least a first portion of the main arm defines a first plane perpendicular to the first pivot axis, and the swing arm is pivoted to the main arm at a location offset from the first plane.

14. The apparatus as claimed in claim 10, wherein each second pivot connection includes a range limiting device for limiting the rotation of the swing arm about the second pivot axis to a predetermined angular range between an inner position and an outer position.

15. The apparatus as claimed in claim 14, wherein the second pivot connection comprises a pivot sleeve on one of the arms, a pivot bracket on the other arm, and a pivot pin extending through the bracket and sleeve to rotatably secure the bracket to the sleeve.

16. The apparatus as claimed in claim 10, wherein each handle comprises a handle bracket having a pivot shaft rotatably secured to the swing arm for rotation about said third pivot axis, and a grip rotatably mounted on the bracket for rotation about a fourth axis perpendicular to the third pivot axis.

17. The apparatus as claimed in claim 16, wherein the grip extends transverse to the third pivot axis and is coplanar with said third pivot axis.

18. The apparatus as claimed in claim 16, wherein each handle bracket is generally c-shaped and has opposite, parallel arms, the grip having a longitudinal axis and being rotatably mounted between the arms of the handle bracket for rotation about said longitudinal axis.

19. The apparatus as claimed in claim 18, wherein each arm of the handle bracket has an outwardly projecting bumper aligned with the axis of said grip.

20. An exercise arm apparatus, comprising:

a pair of exercise arm assemblies;

each arm assembly having a main arm, a swing arm, and a handle;

each main arm having a first end and a second end, a first pivot connection at the first end of the main arm for connection to a main frame of an exercise machine for pivoting of the main arm about a first pivot axis;

each swing arm comprising an elongate member having a first end and a second end;

a second pivot connection directly connecting the first end of each swing arm to the second end of the respective main arm for pivoting of the swing arm about a second pivot axis, the second pivot connection limiting pivoting of the swing arm relative to the main arm to pivoting about the second pivot axis;

each handle having a third pivot connection connecting the handle to the second end of the respective swing arm for pivoting of the handle about a third pivot axis, each pivot axis being non-parallel to the other two pivot axes;

the first pivot axis, main arm, and swing arm of each arm assembly operating in a common plane; and the main and swing arms of each arm assembly each having at least one bend separating the arm into two relatively angled portions with the second pivot axis located between the two bends.

21. The apparatus as claimed in claim 20, wherein the exercise arm assemblies define a central plane of the exercise apparatus, and each swing arm has an inboard side facing said first pivot axis directed towards said central plane and an outboard side, and the handle is pivoted at the inboard side of the swing arm, whereby the handle is positioned on the inboard side of the swing arm in the rest position and all possible exercise positions of the exercise arm assemblies.

22. An exercise arm apparatus, comprising:

at least one main arm having a first pivot connection for connection to a main frame of an exercise machine for pivoting of the main arm about a first pivot axis and at least one free end;

at least one swing arm comprising an elongate member having a first end and a second end;

a second pivot connection directly connecting the first end of the swing arm to the free end of the main arm for pivoting of the swing arm about a second pivot axis; and at least one handle having a third pivot connection connecting the handle to the swing arm for pivoting of the handle about a third pivot axis, each pivot axis being non-parallel to the other two pivot axes;

the second pivot connection including a range limiting device for limiting the rotation of the swing arm about the second pivot axis to a predetermined angular range between an inner position and an outer position; and the swing arm extending substantially vertically downwardly in one of said inner and outer positions.

23. An exercise arm apparatus, comprising:

at least one main arm having a first pivot connection for connection to a main frame of an exercise machine for pivoting of the main arm about a first pivot axis and at least one free end;

at least one swing arm having a first end and a second end;

a second pivot connection connecting the first end of the swing arm to the free end of the main arm for pivoting of the swing arm about a second pivot axis; and at least one handle having a third pivot connection connecting the handle to the swing arm for pivoting of the handle about a third pivot axis, each pivot axis being non-parallel to the other two pivot axes;

the second pivot connection comprising a pivot sleeve on one of the arms, a pivot bracket on the other arm, a pivot pin extending through the bracket and sleeve to rotatably secure the bracket to the sleeve, and a range limiting device for limiting the rotation of the swing arm about the second pivot axis to a predetermined angular range; and the range limiting device comprising a limiter member on the sleeve having a slot defining said angular range, and a pin mounted on the bracket for engagement in the slot;

the swing arm pivoting freely about said second pivot axis over said predetermined angular range, whereby the user can define the motion of the swing arm within said angular range.

24. The apparatus as claimed in claim 23, wherein the range limiting device limits swing of the swing arm to a predetermined angular range between an inner position and an outer position, the outer position comprising a rest position.

25. The apparatus as claimed in claim 24, wherein at least a first part of each swing arm extending from said second pivot connection is angled outwardly in said rest position.

26. An exercise arm apparatus, comprising:

at least one main arm having a first pivot connection for connection to a main frame of an exercise machine for pivoting of the main arm about a first pivot axis and at least one free end;

at least one swing arm having a first end and a second end;

a second pivot connection connecting the first end of the swing arm to the free end of the main for pivoting of the swing arm about a second pivot axis; and at least one handle having a third pivot connection connecting the handle to the swing arm for pivoting of the handle about a third pivot axis each pivot axis being non-parallel to the other two pivot axes;

the second pivot connection comprising a pivot sleeve on one of the arms, a pivot bracket on the other arm, a pivot pin extending through the bracket and sleeve to rotatably secure the bracket to the sleeve, and a range limiting device for limiting the rotation of the swing arm about the second pivot axis to a predetermined angular range; and the range limiting device comprising a limiter member on the sleeve having a slot defining said angular range, and a pin mounted on the bracket for engagement in the slot;

each handle comprising a handle bracket having a pivot shaft rotatably secured to the swing arm for rotation about said third pivot axis, and a grip rotatably mounted on the bracket for rotation about a forth axis perpendicular to the third pivot axis, the grip being offset from the third pivot axis.

27. An exercise arm apparatus, comprising:

a pair of exercise arm assemblies;

each arm assembly having a main arm, a swing arm, and a handle;

each main arm having a first end and a second end, a first pivot connection at the first end of the main arm for connection to a main frame of an exercise machine for pivoting of the main arm about a first pivot axis;

each swing arm having a first end and a second end;

a second pivot connection connecting the first end of the swing arm to the second end of the main arm for pivoting of the swing arm about a second pivot axis;

each handle having a third pivot connection connecting the handle to the second end of the respective swing arm for pivoting of the handle about a third pivot axis, each pivot axis being non-parallel to the other two pivot axes;

each handle comprising a handle bracket having a pivot shaft rotatably secured to the swing arm for rotation about said third pivot axis, and a grip rotatably mounted on the bracket for rotation about a fourth axis perpendicular to said third pivot axis; and each grip having opposite ends, each end of the grip having projecting annular guards for preventing contact between the user's hands when holding the grips on each arm assembly.

28. An exercise arm apparatus, comprising:

a pair of exercise arm assemblies;

each arm assembly having a main arm, an elongate swing arm, and a handle;

each main arm having a first end and a second end, a first pivot connection at the first ends of the main arms for connecting to a main frame of an exercise machine for pivoting of the main arms about a common first pivot axis;

each swing arm having a first end and a second end;

a second pivot connection connecting the first end of each swing arm to the second end of the respective main arm for pivoting of the swing arm about a second pivot axis;

each handle having a third pivot connection connecting the handle to the respective swing arm for pivoting of the handle about a third pivot axis, each pivot axis being non-parallel to the other two pivot axes; and each swing arm having an inboard side directed towards the other swing arm and an opposite, outboard side directed away from the other swing arm, and each handle being located on the inboard side of the respective swing arm in all exercise and rest positions of the exercise arm assemblies.

29. An exercise arm apparatus, comprising:

a main arm having a first pivot connection for pivotal connection to a support frame for pivoting of the main arm about a first pivot axis;

at least a first swing arm having a first end and a second end;

a second pivot connection directly connecting the first swing arm to the main arm for pivoting of the first swing arm about a second pivot axis non-parallel with the first pivot axis, the second pivot connection limiting pivoting of the first swing arm to pivoting about said second pivot axis;

a handle associated with the first swing arm; and the second pivot connection including a range limiting device for limiting rotation of the first swing arm about the second pivot axis, the range limiting device defining an outer position for the swing arm, the outer position comprising a rest position.

30. An exercise arm apparatus, comprising:

a main arm having a first pivot connection for connection to a main frame of an exercise machine for pivoting of the main arm about a first pivot axis, and first and second portions extending from said first pivot connection;

first and second swing arms each having a first end and a second end;

the first swing arm having a second pivot connection connecting the first swing arm to the first portion of the main arm for rotation about a second pivot axis at a location spaced from the first pivot connection;

the second swing arm having a third pivot connection connecting the second swing arm to the second portion of the main arm for rotation about a third pivot axis at a location spaced from the first pivot connection;

a handle associated with each swing arm;

the first and second portions of the main arm each having a bend separating the respective main arm portion into a first part extending from the first pivot connection to the bend and a second part inclined from the first part;

each swing arm having a bend separating the swing arm into a first part extending from the first end of the respective swing arm to the bend and a second part extending from the bend to the handle; and the second and third pivot connections each including a range limiting device for limiting the outward swing of the respective swing arm about the respective second and third pivot axis, each range limiting device defining an outer stop position for the respective swing arm.

* * * * *